US012767381B2

(12) United States Patent
McCarthy

(10) Patent No.: US 12,767,381 B2
(45) Date of Patent: Oct. 20, 2026

(54) HAND FORMED REINFORCED CONTAINERS AND BLANKS FOR SAME

(71) Applicant: WestRock Shared Services, LLC, Atlanta, GA (US)

(72) Inventor: Timothy L. McCarthy, Wilmette, IL (US)

(73) Assignee: WestRock Shared Services, LLC, Atlanta, GA (US)

( * ) Notice: Subject to any disclaimer, the term of this patent is extended or adjusted under 35 U.S.C. 154(b) by 282 days.

(21) Appl. No.: 18/202,121

(22) Filed: May 25, 2023

(65) Prior Publication Data

US 2024/0391639 A1 Nov. 28, 2024

(51) Int. Cl.

| | |
|---|---|
| ***B65D 5/44*** | (2006.01) |
| ***B65D 5/00*** | (2006.01) |
| ***B65D 5/42*** | (2006.01) |

(52) U.S. Cl.

CPC ..... *B65D 5/443* (2013.01); *B65D 5/0015* (2013.01); *B65D 5/4266* (2013.01)

(58) Field of Classification Search

CPC .... B65D 5/443; B65D 5/0015; B65D 5/4266; B65D 5/22; B65D 5/28; B65D 5/4608; B65D 5/248

USPC ..... 229/100, 918, 919, 177, 178, 117.13, 229/179, 193, 915, 186, 190; 206/512; 220/62, 604

See application file for complete search history.

(56) References Cited

U.S. PATENT DOCUMENTS

| | | | | |
|---|---|---|---|---|
| 3,202,337 | A * | 8/1965 | Cramer | B65D 5/248 229/125.17 |
| 3,883,067 | A * | 5/1975 | McGlynn | B65D 5/22 229/179 |
| 4,676,429 | A * | 6/1987 | Crowe | B65D 5/2033 229/117.17 |
| 5,289,970 | A * | 3/1994 | McClure | B65D 5/6632 229/149 |
| 6,098,873 | A * | 8/2000 | Sheffer | B65D 5/2009 229/178 |
| 7,669,754 | B2 * | 3/2010 | Teixidor Casanovas | B65D 5/3642 229/117.03 |
| 7,717,320 | B2 * | 5/2010 | Quaintance | B65D 5/4608 229/110 |
| 8,887,982 | B2 | 11/2014 | Smith et al. | |
| 2005/0067478 | A1 * | 3/2005 | McClure | B65D 5/22 229/177 |
| 2014/0084047 | A1 * | 3/2014 | McLeod | B65D 5/003 229/109 |

* cited by examiner

*Primary Examiner* — Christopher R Demeree
(74) *Attorney, Agent, or Firm* — Neil G. Cohen; Rohini K. Garg

(57) ABSTRACT

A blank of sheet material for forming a polygonal container includes a bottom panel, two opposing side panels each extending from a side edge of the bottom panel, and two opposing end panels each extending from an end edge of the bottom panel. The blank also includes a foldover panel that is configured to lock the container in at least a partially formed position. The blank further includes a reinforcing panel assembly that includes an outer reinforcing corner panel extending from the first side panel, an outer reinforcing end panel extending from the outer reinforcing corner panel, an inner reinforcing end panel extending from the outer reinforcing end panel, and an inner reinforcing corner panel extending from the inner reinforcing end panel.

13 Claims, 2 Drawing Sheets

HAND FORMED REINFORCED CONTAINERS AND BLANKS FOR SAME

BACKGROUND

1. Field

The field of the invention relates generally to a blank and a reinforced polygonal container formed from the blank and more particularly, to a reinforced polygonal container that is hand formed from a blank for transporting a product stored within the container.

2. Description of Related Art

Containers are frequently utilized to store and aid in transporting products. These containers can be square, hexagonal, or octagonal. The shape of the container can provide additional strength to the container. For example, octagonal-shaped containers provide greater resistance to bulge over conventional rectangular, square or even hexagonal-shaped containers. An octagonal-shaped container may also provide increased stacking strength.

In at least some known cases, a blank of sheet material is used to form a container for transporting a product. More specifically, these known containers are formed by a machine that folds a plurality of panels along fold lines and secures these panels with an adhesive. Such containers may have certain strength requirements for transporting products. These strength requirements may include a stacking strength requirement such that the containers can be stacked on one another during transport without collapsing. To meet these strength requirements, at least some known containers include reinforced corners or side walls for providing additional strength including stacking strength. In at least some known embodiments, additional panels may be placed in a face-to-face relationship with another corner panel or side wall. However, it is difficult to form a container from a single sheet of material that includes multiple reinforcing panels along the corner and side walls. Further, it is increasingly difficult to form such a container by hand in the field, that is, without any machinery, and with little to no adhesive.

Machinery needed to quickly form and glue reinforced containers can require a substantial capital investment. Moreover, these machines can be costly to run and difficult to maintain, especially when the containers are being formed in the field for transporting agricultural products. In these agricultural applications, these machines are almost impractical to use. Accordingly, a need exists for a multi-sided reinforced container that is easily formed by hand from a single blank with little or no adhesive.

The conventional techniques have been considered satisfactory for their intended purpose. However, there is an ever present need for improved systems and methods for hand formed, reinforced containers. This disclosure provides a solution for this need.

SUMMARY

In one aspect, a blank of sheet material for forming a polygonal container is provided. The blank includes a bottom panel, two opposing side panels each extending from a side edge of the bottom panel, and two opposing end panels each extending from an end edge of the bottom panel. The blank also includes a first foldover panel extending from a top edge of a first end panel of the two end panels. The first foldover panel is configured to lock the container in at least a partially formed position. The blank also includes a reinforcing panel assembly extending from a first side edge of a first side panel of the two side panels. The reinforcing panel assembly includes an outer reinforcing corner panel extending from the first side edge of the first side panel, an outer reinforcing end panel extending from a side edge of the outer reinforcing corner panel, an inner reinforcing end panel extending from a side edge of the outer reinforcing end panel, and an inner reinforcing corner panel extending from a side edge of the inner reinforcing end panel. The inner reinforcing corner panel defines a terminal edge of the reinforcing panel assembly.

In another aspect, a polygonal container formed from a blank of sheet material is provided. The container includes a bottom wall, two opposing side walls where each side wall emanates from a side edge of the bottom wall, two opposing end walls where each end wall includes an end panel and a foldover panel, and a first reinforcing panel assembly. Each end wall emanates from an end edge of the bottom wall. Each foldover panel is opposite to the end edge and is configured to lock the container in at least a partially formed position. The first reinforcing panel assembly extends between a first end wall of the two end walls and a first side wall of the two side walls. The first reinforcing panel assembly includes a corner panel and an inner reinforcing corner panel at least partially overlying the corner panel.

In yet another aspect, a method for forming a polygonal container from a blank of sheet material is provided. The container has at least five sides including a bottom panel, two opposing side panels each extending from a side edge of the bottom panel, and two opposing end panels each extending from an end edge of the bottom panel. The container also includes a first foldover panel extending from a top edge of a first end panel of the two end panels, and a reinforcing panel assembly extending from a first side edge of a first side panel of the two side panels. The reinforcing panel assembly includes an outer reinforcing corner panel extending from the first side edge of the first side panel, an outer reinforcing end panel extending from a side edge of the corner panel, an inner reinforcing end panel extending from a side edge of the outer reinforcing end panel, and an inner reinforcing corner panel extending from a side edge of the inner reinforcing end panel. The inner reinforcing corner panel defines a terminal edge of the reinforcing panel assembly. The method includes rotating the inner reinforcing end panel toward an interior surface of the outer reinforcing end panel about a fold line connecting the inner reinforcing end panel and the outer reinforcing end panel. The outer reinforcing end panel includes a first cutout defined along a top edge thereof, and the inner reinforcing end panel includes a second cutout defined along a top edge thereof. The outer and inner reinforcing end panels are positioned in a substantially face-to-face relationship with the first cutout and the second cutout aligned to form a locking slot. The method also includes rotating the outer and inner reinforcing end panels toward an interior surface of the first side panel about a fold line connecting the inner reinforcing end panel and the inner reinforcing corner panel and about a fold line connecting the outer reinforcing end panel and the outer reinforcing corner panel. The method further includes rotating the outer reinforcing corner panel and the inner reinforcing corner panel toward the interior surface of the first side panel about a fold line connecting the outer reinforcing corner panel and the first side panel. The method also includes rotating the first side panel inwardly into a substantially perpendicular relationship with the bottom panel about a fold line connecting the first side panel and the bottom panel such that the first side panel forms a first side wall of the polygonal container and the outer reinforcing corner panel and the inner reinforcing corner panel form a first corner wall of the polygonal container.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
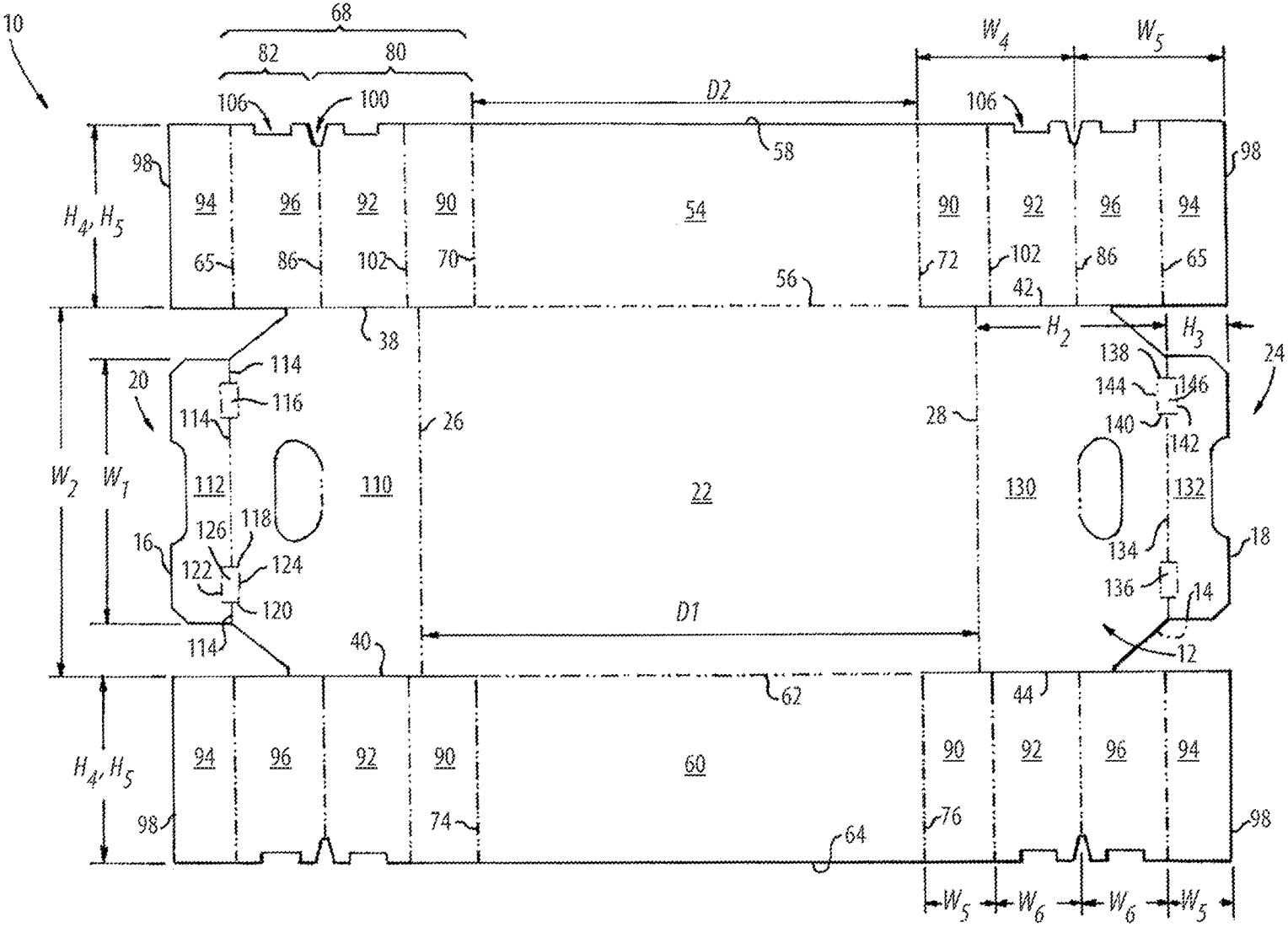
FIG. 1 is a top plan view of a blank of sheet material for constructing a container according to a first embodiment.

Reference will now be made to the drawings wherein like reference numerals identify similar structural features or aspects of the subject disclosure. For purposes of explanation and illustration, and not limitation, a partial view of an embodiment of a blank in accordance with the disclosure is shown in FIG. 1 and is designated generally by reference character 100. Other embodiments of systems in accordance with the disclosure, or aspects thereof, are provided in FIG. 2, as will be described.

The present invention provides a stackable, reinforced container formed from a single sheet of material, and a method for constructing the container. The container is sometimes referred to as a reinforced mitered tray or a reinforced eight-sided tray, or a hand-formed tray-8. The container may be manually constructed, that is, hand-formed, from a blank of sheet material. In one embodiment, the container is fabricated from a cardboard material. The container, however, may be fabricated using any suitable material, and therefore is not limited to a specific type of material. In alternative embodiments, the container is fabricated using cardboard, plastic, fiberboard, paperboard, foamboard, corrugated paper, and/or any suitable material known to those skilled in the art and guided by the teachings herein provided.

In an example embodiment, the container includes at least one marking thereon including, without limitation, indicia that communicates the product, a manufacturer of the product and/or a seller of the product. For example, the marking may include printed text that indicates a product's name and briefly describes the product, logos and/or trademarks that indicate a manufacturer and/or seller of the product, and/or designs and/or ornamentation that attract attention. "Printing," "printed," and/or any other form of "print" as used herein may include, but is not limited to including, ink jet printing, laser printing, screen printing, giclée, pen and ink, painting, offset lithography, flexography, relief print, rotogravure, dye transfer, and/or any suitable printing technique known to those skilled in the art and guided by the teachings herein provided.

In another embodiment, the container is void of markings, such as, without limitation, indicia that communicates the product, a manufacturer of the product and/or a seller of the product. In the example embodiment, the container is erected by hand and locked into the erect or formed position without the use of any adhesive or glue. In an alternative embodiment, the container is erected into an erect position with a minimum amount of glue or adhesive.

Referring now to the drawings, and more specifically to FIG. 1, which is a top plan view of an example embodiment of a blank 10 of sheet material. A container 150 (shown in FIG. 2) is formed from blank 10. Blank 10 has a first or interior surface 12 and an opposing second or exterior surface 14. Further, blank 10 defines a leading edge 16 and an opposing trailing edge 18. In one embodiment, blank 10 includes, in series from leading edge 16 to trailing edge 18, a front panel assembly 20, a bottom panel 22, and a rear panel assembly 24, coupled together along preformed, generally parallel, fold lines 26 and 28, respectively. Front panel assembly 20 and rear panel assembly 24 are also considered to be end panel assemblies. The container formed from blank 10 may be referred to as an open-top reinforced mitered tray and/or a hand-formed tray-8 container.

More specifically, front panel assembly 20 extends from leading edge 16 to fold line 26, bottom panel 22 extends from front panel assembly 20 along fold line 26, and rear panel assembly 24 extends from bottom panel 22 along fold line 28 to trailing edge 18. Fold lines 26 and/or 28, as well as other fold lines and/or hinge lines described herein, may include any suitable line of weakening and/or line of separation known to those skilled in the art and guided by the teachings herein provided. Front and rear panel assemblies 20 and 24, respectively, may be considered to be end panels. When container 150 is formed from blank 10, fold line 26 defines a bottom edge of front panel assembly 20 and a front edge, or first end edge, of bottom panel 22, and fold line 28 defines a rear edge, or second end edge, of bottom panel 22 and a bottom edge of rear panel assembly 24. As used through this description, front edges and rear edges are also considered to be end edges.

Front panel assembly 20 and rear panel assembly 24 are substantially congruent and have a rectangular shape. Bottom panel 22 has a rectangular shape. More specifically, front panel assembly 20 and rear panel assembly 24 have a width W1. Bottom panel 22 has a width W2, which is substantially equal to that width W1. Further, in the exemplary embodiment, front and rear panel assemblies 20 and 24, respectively, have a first height H1, and bottom panel 22 has a first depth D1 that is larger than first height H1 (H1 is not labeled in FIG. 1 for sake of clarity in the reference characters, however it is the sum of heights H2 and H3). In another embodiment, height H1 is substantially equal to or larger than depth D1. In the exemplary embodiment, front panel assembly 20, rear panel assembly 24, and/or bottom panel 22 are equally dimensioned, however, front panel assembly 20, rear panel assembly 24, and/or bottom panel 22 may be other than equally dimensioned. The bottom panel 22 can have any suitable shape that enables container 150 to function as described herein.

In the exemplary embodiment, front panel assembly 20 includes two free side edges 38 and 40, and rear panel assembly 24 includes two free side edges 42 and 44. Side edges 38, 40, 42, and 44 are substantially parallel to each other. Alternatively, side edges 38, 40, 42, and/or 44 are other than substantially parallel. In the exemplary embodiment, each side edge 38, 40, 42, and 44 is connected to a respective angled edge 30, 32, 34, or 36. Each side edge 38, 40, 42, and 44 may be slightly offset from fold lines 56, 62 along respective edges of the bottom panel 22 to facilitate forming container 150 from blank 10 by allowing clearance for a thickness of a panel that is directly or indirectly attached to front panel assembly 20 or rear panel assembly 24.

A first side panel 54 extends from bottom panel 22 along a fold line 56 to a free edge 58, and a second side panel 60 extends from bottom panel 22 along a fold line 62 to a free edge 64. Fold line 56 defines a bottom edge of first side panel 54 and a side edge of bottom panel 22, and fold line 62 defines a bottom edge of second side panel 60 and a side edge of bottom panel 22. First and second side panels 54 and 60 are each generally rectangularly shaped. Side panels 54 and 60 each have a depth D2 that is shorter than depth D1 such that side panels 54 and 60 are narrower than bottom panel 22. In the exemplary embodiment, fold line 56 extends between ends of edges 38, 42, and fold line 62 extends between ends of edges 40, 44. Further, in the exemplary embodiment, blank 10 does not include finger cutouts that may facilitate handling of container 150. In an alternative embodiment, at least one oval shaped finger cutout (not shown) is defined within first and second side panels 54 and 60. Alternatively, any number of finger cutouts may be of any shape and/or defined within any suitable panel such that handling of container 150 is facilitated.

In the exemplary embodiment, a reinforcing panel 68 extends from side edges of each side panel 54 and 60. Reinforcing panel 68 is also referred to herein as a reinforcing panel assembly that includes a plurality of panels as described in more detail herein. Each side edge is defined by a respective fold line 70, 72, 74, or 76. Fold lines 70, 72, 74, and 76 are substantially parallel to each other. Alternatively, fold lines 70, 72, 74, and/or 76 are other than substantially parallel. In the exemplary embodiment, each reinforcing panel 68 includes a free bottom edge 78, e.g. separated from its adjacent edge 34, 40 by only a cut with no intervening gap. Further, each reinforcing panel 68 is substantially similar and includes an outer reinforcing panel assembly 80 and an inner reinforcing panel assembly 82 connected along fold line 86. Fold line 86 defines a side edge of outer reinforcing panel assembly 80 and a side edge of inner reinforcing panel assembly 82. Moreover, outer reinforcing panel assembly 80 includes an outer reinforcing corner panel 90 and an outer reinforcing end panel 92; and inner reinforcing panel assembly 82 includes an inner reinforcing corner panel 94, and an inner reinforcing end panel 96. The inner reinforcing corner panel 94 defines a terminal or free edge of the reinforcing panel assembly 80.

More specifically, outer reinforcing panel assembly 80 extends along each of fold lines 70, 72, 74, and 76. Further, inner reinforcing panel assembly 82 extends from each outer reinforcing panel assembly 80 along fold line 86 to the free edge 98. A notch 100 is formed along fold line 86 between inner reinforcing panel assemblies 82 and outer reinforcing panel assemblies 80. Inner reinforcing panel assemblies 82 and outer reinforcing panel assemblies 80 are substantially rectangular in shape. More specifically, inner reinforcing panel assemblies 82 have a width W3, and outer reinforcing panel assemblies 80 have a width W4, where W3 and W4 are substantially equal. Widths of individual reinforcing corner panels 90, 94 are substantially equal to one another, and the widths of the reinforcing end panels 92, 96 are substantially equal to one another.

The inner reinforcing corner panel 94 is free of fold lines between the side edge 65 of the inner reinforcing end panel 96 and the terminal edge 98. The inner reinforcing end panel 96 is free of fold lines between the side edge 65 of the inner reinforcing end panel 96 and the side edge 86 of the outer reinforcing end panel 92. The outer reinforcing end panel 92 is free of fold lines between the side edge 86 of the outer reinforcing end panel 92 and the side edge 102 of the outer reinforcing corner panel 90. The outer reinforcing corner panel 90 is free of fold lines between the side edge 102 of the outer reinforcing corner panel 90 and the first side edge 70, 72 of the respective side panel 54, 60.

Each outer reinforcing panel assembly 80 includes a fold line 102 that divides each outer reinforcing panel assembly 80 into outer reinforcing corner panel 90 and outer reinforcing end panel 92. Fold line 102 defines an edge of outer reinforcing corner panel 90 and a side edge of outer reinforcing end panel 92, and fold line 86 defines a side edge of outer reinforcing end panel 92. In the exemplary embodiment, corner panel 90 and end panel 92 are substantially rectangular. Further, in the exemplary embodiment, each inner reinforcing panel assembly 82 includes fold lines 104 that divides each inner reinforcing panel assembly 82 into inner reinforcing corner panel 94, inner reinforcing end panel 96, and inner reinforcing side panel 97. Specifically, fold line 104 defines an edge of inner reinforcing corner panel 94 and a side edge of inner reinforcing end panel 96.

In the exemplary embodiment, inner reinforcing corner panel 94 and inner reinforcing end panel 96 are substantially rectangular. Further, outer reinforcing corner panel 90 and inner reinforcing corner panel 94 are substantially congruent, and outer and inner reinforcing end panels 92 and 96, respectively, are substantially congruent. Moreover, outer and inner reinforcing end panels 92 and 96, respectively, each define a cutout 106, wherein cutouts 106 are positioned equidistantly from fold line 86.

Front panel assembly 20 includes a first end panel 110 coupled to bottom panel 22 at fold line 26. Front panel assembly 20 also includes a first foldover panel 112 coupled to first end panel 110 at a fold line 114 having a plurality of cut lines. Front panel assembly 20 also includes a plurality of first hinge tabs 116. First hinge tabs 116 are defined by cut lines 118 and 120 and fold lines 122 and 124. Cut lines 118 and 120 are substantially perpendicular to leading edge 16, and fold lines 122 and 124 are substantially parallel to leading edge 16. Each of first hinge tabs 116 is substantially rectangular and includes at least a portion of first end panel 110 and first foldover panel 112. Therefore, hinge tabs 116 couple first end panel 110 to first foldover panel 112. In the exemplary embodiment, front panel assembly 20 includes two first hinge tabs 116. Alternatively, front panel assembly 20 includes any number of first hinge tabs 116. Also, in the exemplary embodiment, fold line 114 is oriented to define a bisecting line 126 through each of first hinge tabs 116 such that hinge tabs 116 include approximately 50% first end panel 110 and 50% first foldover panel 112. Alternatively, fold line 114 is oriented to define any line 126 through each of first hinge tabs 116 such that hinge tabs 116 include any proportions of first end panel 110 and first foldover panel 112.

Rear panel assembly 24 includes a second end panel 130 coupled to bottom panel 22 at fold line 28. Rear panel assembly 24 also includes a second foldover panel 132 coupled to second end panel 130 at a fold line 134 having a plurality of cut lines. Rear panel assembly 24 also includes a plurality of second hinge tabs 136. Second hinge tabs 136 are defined by cut lines 138 and 140 and fold lines 142 and 144. Cut lines 138 and 140 are substantially perpendicular to leading edge 18, and fold lines 142 and 144 are substantially parallel to leading edge 18. Each of second hinge tabs 136 is substantially rectangular and includes at least a portion of second end panel 130 and second foldover panel 132. Therefore, hinge tabs 136 couple second end panel 130 to second foldover panel 132. In the exemplary embodiment, rear panel assembly 24 includes two second hinge tabs 136. Alternatively, rear panel assembly 24 includes any number of second hinge tabs 136. Also, in the exemplary embodiment, fold line 134 is oriented to define a bisecting line 146 through each of second hinge tabs 136 such that hinge tabs 136 include approximately 50% second end panel 130 and 50% second foldover panel 132. Alternatively, fold line 134 is oriented to define any line 146 through each of second hinge tabs 136 such that hinge tabs 136 include any proportions of second end panel 130 and second foldover panel 132.

Each outer reinforcing corner panel 90 and each inner reinforcing corner panel 94 have a width W5. In addition, each outer reinforcing end panel 92 and inner reinforcing end panel 96 have a width W6 that is greater than width W5. In an alternative embodiment, width W6 is approximately equal to width W5. Moreover, in the exemplary embodiment, width W3 is substantially equal to a sum of widths W5 and W6, and width W4 is substantially equal to a sum of widths W5 and W6.

First and second end panels 110 and 130, respectively, each have a height H2 and first and second foldover panels 112 and 132, respectively, each have a height H3 that is substantially equal to width W5. A sum of height H2 and height H3 is substantially equal to height H1. Moreover, each of first and second side panels 54 and 60, respectively, has a height H4 that is substantially equal to height H2 of first and second end panels 110 and 130, respectively. Further, in the exemplary embodiment, inner and outer reinforcing panel assemblies 82 and 80, respectively, have a height H5 that is substantially similar to height H4 of first and second side panels 54 and 60, respectively.

Figure 2:
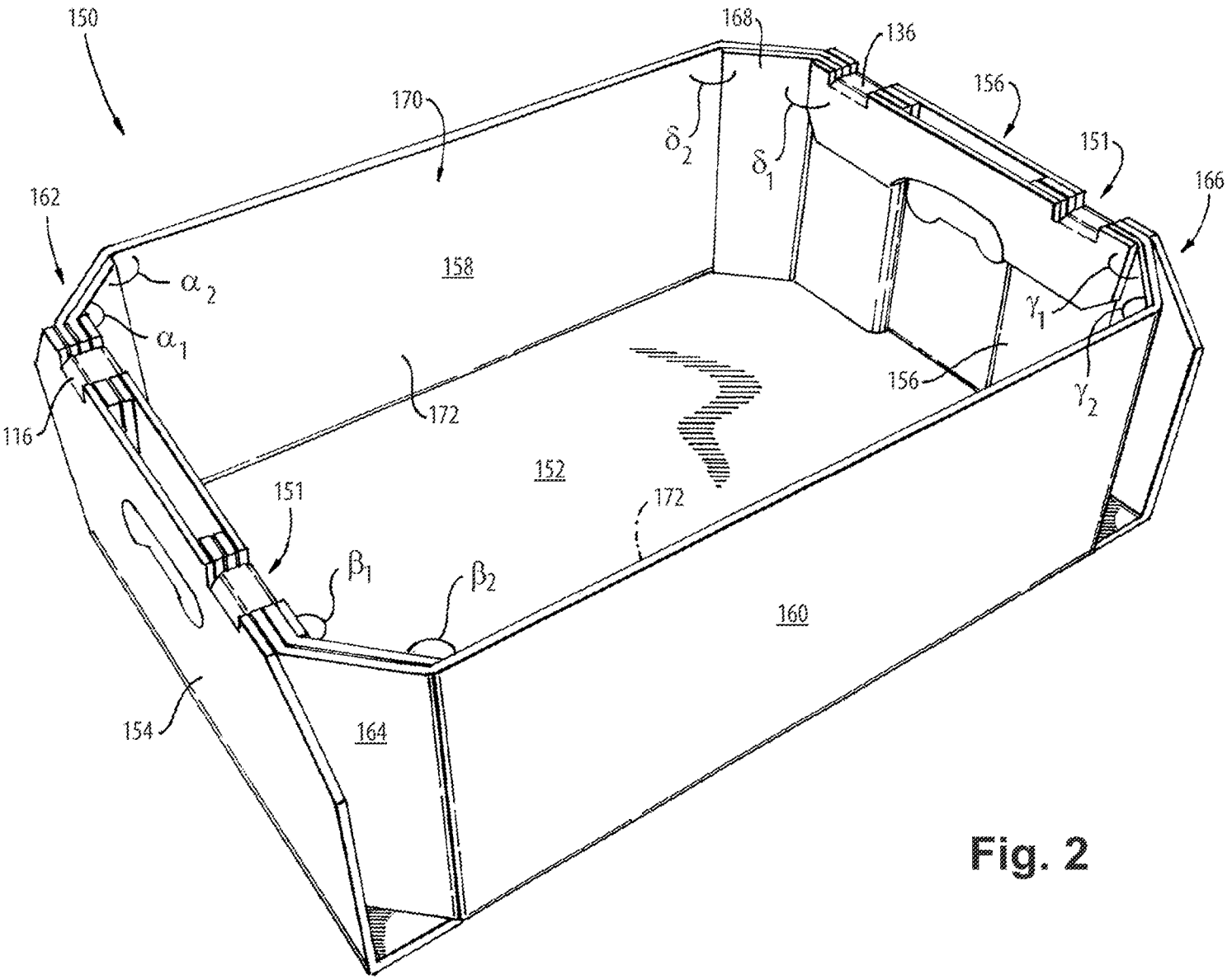
FIG. 2 is a perspective view of a container formed from the blank shown in FIG. 1.

FIG. 2 is a perspective view of container 150 that is formed from blank 10 (shown in FIG. 1). Although container 150 is shown as being formed without a product to be contained therein, container 150 may also be formed having a product therein. Further, container 150 may include any suitable number of products of any suitable shape. In the exemplary embodiment, bottom panel 22 is sized to correspond to product(s) contained within container 150.

Container 150 may be formed by hand from blank 10. Container 150 is formed by erecting and positioning the panels of blank 10 into an erect or formed position. Container 150 may be held or locked into the formed position without the use of glue or adhesives for adhering one panel to another panel.

More specifically, respective inner reinforcing panel assembly 82 are folded about fold line 86 such that inner reinforcing panel assembly 82 and outer reinforcing panel assembly 80 are in an at least partially overlying relationship. As used herein, an at least partially overlaying relationship exists when a first panel is extending in a plane that is substantially parallel to the plane of a second panel such that the first and second panels obscure a portion of each other. Moreover, the panels do not have to be in contact with each other and a third panel may be positioned therebetween.

Also, more specifically, blank 10 is folded along fold line 86 such that outer reinforcing corner panel 90 and inner reinforcing corner panel 94 are substantially aligned in an at least partially overlying relationship, outer and inner reinforcing end panels 92 and 96, respectively, are substantially aligned in an at least partially overlying relationship. Cutouts 106 defined in overlying outer and inner reinforcing end panels 92 and 96, respectively, are substantially aligned, thereby forming a locking slot 151.

In the exemplary embodiment, inner reinforcing side panel 97, a respective side panel 54 or 60, reinforcing end panels 92 and 96, and/or outer reinforcing corner panel 90 and inner reinforcing corner panel 94 can be secured by hand and without adhesives in the above-described relationships. For example, a respective side panel 54 or 60, reinforcing end panels 92 and 96, and/or corner panel 90 and inner reinforcing corner panel 94 are held by a force applied by the person erecting container 150 on exterior surface 14 as container 150 continues to be erected. Also, in the exemplary embodiment, no adhesives are used to assemble container 150. Alternatively, small amounts of adhesive are used to assemble container 150.

Reinforcing panel assemblies 80 and 82 are rotated about fold lines 70, 72, 74, and 76. Further, reinforcing end panels 92 and 96 are rotated about fold lines 102 and 104 toward corner panels 90 and 94 before or after reinforcing panel assemblies 80 and 82 are rotated about fold lines 70, 72, 74, and 76. In the exemplary embodiment, reinforcing panel assemblies 80 and 82 and reinforcing end panels 92 and 96 are rotated such that reinforcing end panels 92 and 96 are substantially perpendicular to side panels 54 and 60. First and second side panels 54 and 60, respectively, are then rotated about fold lines 56 and 62, respectively, toward interior surface 12.

Front panel assembly 20 is rotated about fold line 26 toward interior surface 12, and rear panel assembly 24 is rotated about fold line 28 toward interior surface 12. More specifically, front panel assembly 20 and rear panel assembly 24 are rotated to be substantially perpendicular to bottom panel 22, as shown in FIG. 2.

First foldover panel 112 is rotated about fold line 114 toward first end panel 110 such that first foldover panel 112 and first end panel 110 are substantially aligned in an at least partially overlying relationship. Moreover, each of first hinge tabs 116 is disposed or inserted within locking slot 151 to define an interference, or friction fit therein. Locking each first hinge tab 116 within locking slot 151 facilitates securing front panel assembly 20 to reinforcing panel assembly 68 and, indirectly to side panels 54 or 60. In the exemplary embodiment, no adhesives are used to assembly container 150. Alternatively, small amounts of adhesive are used to assembly container 150.

Similarly, second foldover panel 132 is rotated about fold line 134 toward second end panel 130 such that second foldover panel 132 and second end panel 130 are substantially aligned in an at least partially overlying relationship. Moreover, each of second hinge tabs 136 is disposed or inserted within locking slot 151 to define an interference, or friction fit therein. Locking each second hinge tab 136 within locking slot 151 facilitates securing front panel assembly 20 to reinforcing panel assembly 68 and, indirectly to side panels 54 or 60. Therefore, hinge tabs 116 lock container 150 in a formed position. In the exemplary embodiment, no adhesives are used to assembly container 150. Alternatively, small amounts of adhesive are used to assembly container 150.

When container 150 is formed, interior surface 12 of front and rear panel assemblies 20 and 24 is adjacent the side walls of the product. Further, height H2 of first and second end panels 110 and 130, respectively, is sized to correspond to a height of the products within container 150 such that height H2 is substantially equal to or greater than the height of the products. Bottom panel 22 forms a bottom wall 152 of container 150, first end panel 110 and a pair of reinforcing end panels 92 and 96 forms a front wall 154 of container 150, and second end panel 130 and a pair of reinforcing end panels 92 and 96 forms a rear wall 156 of container 150. In the exemplary embodiment, opposing pairs of overlying reinforcing end panels 92 and 96 associated with each of walls 154 and 156 do not extend to completely overlie interior surface 12 of first and second end panels 110 and 130, respectively. Therefore, in the exemplary embodiment, at least a portion of interior surface 12 of end panels 110 and 130 is exposed.

Front wall 154 and rear wall 156 are also referred to as end walls of container 150. First side panel 54 forms a first side wall 158, and side panel 60 forms a second side wall 160. Each pair of reinforcing corner panels 90 and 94 forms first corner wall 162, second corner wall 164, third corner wall 166, and fourth corner wall 168. Bottom wall 152, front wall 154, rear wall 156, first side wall 158, second side wall 160, and corner walls 162, 164, 166, and 168 define a cavity 170 of container 150.

One of the corner walls 162 is at each end of each of the two opposing side walls 158, 160. The inward facing surfaces 172 of each of the two opposing side walls 158, 160 extending between the respective corner walls 162, as oriented in FIG. 2, face each other and face into the interior space 170, forming a boundary of the interior space 170, and are substantially free of any panels intervening between the inward facing surfaces 172.

In the exemplary embodiment, first corner wall 162 is oriented at an oblique angle $\alpha 1$ to front wall 154 and an oblique angle $\alpha 2$ to side wall 158. Similarly, second corner wall 164 is oriented at an oblique angle $\beta 1$ to front wall 154 and an oblique angle $\beta 2$ to side wall 160. Similarly, third corner wall 166 is oriented at an oblique angle $\gamma 1$ to rear wall 156 and an oblique angle $\gamma 2$ to side wall 160, and fourth corner wall 168 is oriented at an oblique angle $\delta 1$ to rear wall 156 and an oblique angle $\delta 2$ to side wall 158. In the exemplary embodiment, angles $\alpha 1$, $\alpha 2$, $\beta 1$, $\beta 2$, $\gamma 1$, $\gamma 2$, $\delta 1$, and $\delta 2$ are substantially equal, however, angles $\alpha 1$, $\alpha 2$, $\beta 1$, $\beta 2$. $\gamma 1$, $\gamma 2$, $\delta 1$, and/or $\delta 2$ can be other than equal depending of the products positioned within container 150. Further, in the exemplary embodiment, bottom edges 78 of reinforcing panels 68 are substantially aligned with fold lines 26, 28, 56, and 62 and angled edges 30, 32, 34, and 36. Container 150 has a configuration referred to herein as an "open configuration."

In the exemplary embodiment, container 150 is hand formed. Alternatively, the above-described method to construct container 150 from blank 10 may be at least partially performed using a machine. In the example embodiment, each of the reinforcing corner assemblies forms a reinforced corner of container 150. In other words, the end panels form end walls, the side panels form side walls, and the reinforced corner assemblies form reinforced corners including corner walls resulting in an eight sided container 150. The reinforced corners include locking slots positioned adjacent to each of the end walls for receiving the hinge tabs of the foldover panels for locking the container in the formed position.

The above-described blanks and containers provide a reinforcing polygonal container. More specifically, the embodiments described herein provide an octagonal container with a rectangular bottom panel having reinforced corner walls, side walls, and end walls for storing and/or transporting a product therein. Further, the embodiments described herein provide a polygonal container having a plurality of hinge tabs. More specifically, a plurality of hinge tabs may be defined with cut lines and fold lines and such hinge tabs become prominent as an associated foldover panel is rotated toward an associated end panel. The hinge tabs are inserted into cutouts defined within adjacent reinforcing panels such that portions of the container are locked into position.

Exemplary embodiments of a container formed to contain a product therein and blanks for making the same are described above in detail. The blanks and the container are not limited to the specific embodiments described herein, but rather, components of the blanks and/or the container may be utilized independently and separately from other components described herein. For example, the blanks may also be used in combination with other types of product, and is not limited to practice with only the cylindrical products, as described herein. Rather, the exemplary embodiments can be implemented and utilized in connection with many other container applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A blank of sheet material for forming a polygonal container, said blank comprising: a bottom panel, the bottom panel having at least one side edge, and at least one end edge; two opposing side panels, each side panel extending from a side edge of the bottom panel; two opposing end panels, each end panel extending from an end edge of the bottom panel; a first foldover panel extending from a top edge of a first end panel of the two end panels, the first foldover panel configured to lock the container in at least a partially formed position;

a reinforcing panel assembly extending from a first side edge of a first side panel of the two side panels, the reinforcing panel assembly including: an outer reinforcing corner panel extending from the first side edge of the first side panel; an outer reinforcing end panel extending from a side edge of the outer reinforcing corner panel; an inner reinforcing end panel extending from a side edge of the outer reinforcing end panel; and an inner reinforcing corner panel extending from a side edge of the inner reinforcing end panel, wherein the first side panel is configured to form a first side wall of the container, and each of the first and the second reinforcing end panels is configured to form a first end wall of the container;

wherein the outer reinforcing corner panel and the inner reinforcing corner panel are configured to be disposed in juxtaposed face-to-face relation to one another to form a corner wall of the container, wherein the inner reinforcing corner panel defines a terminal edge of the reinforcing panel assembly;

wherein the outer reinforcing end panel comprises a first cutout defined along a top edge thereof; and the inner reinforcing end panel comprises a second cutout defined along a top edge thereof;

wherein the first cutout aligns with the second cutout to form a locking slot when the inner reinforcing end panel is folded inwardly in a face-to-face relationship with the outer reinforcing end panel.

2. The blank in accordance with claim 1, wherein the bottom panel is rectangle-shaped.

3. The blank in accordance with claim 1, wherein the inner reinforcing corner panel is free of fold lines between the side edge of the inner reinforcing end panel and the terminal edge, wherein the inner reinforcing end panel is free of fold lines between the side edge of the inner reinforcing end panel and the side edge of the outer reinforcing end panel, wherein the outer reinforcing end panel is free of fold lines between the side edge of the outer reinforcing end panel and the side edge of the outer reinforcing corner panel, and wherein the outer reinforcing corner panel is free of fold lines between the side edge of the outer reinforcing corner panel and the first side edge of the first side panel.

4. The blank in accordance with claim 1, wherein a bottom edge of the reinforcing panel assembly is separated by a cut line from a lateral edge of the first end panel and from the bottom panel.

5. The blank assembly as recited in claim 1, wherein the outer reinforcing corner panel has a width equal to a first width, wherein the inner reinforcing corner panel has a width equal to the first width, wherein the outer reinforcing end panel has a width equal to a second width, and wherein the inner reinforcing end panel has a width equal to the second width.

6. The blank in accordance with claim 1, wherein the reinforcing panel assembly is one in a plurality of reinforcing panel assemblies, wherein each side panel comprises one reinforcing panel assembly of the plurality of reinforcing panel assemblies extending from opposing side edges thereof.

7. A blank in accordance with claim 1, further comprising at least one hinge tab connecting the first foldover panel to the first end panel, wherein the locking slot is configured to receive the at least one hinge tab for locking the container in at least a partially formed position when the first foldover panel is folded inwardly in an at least partially overlying relationship with the first end panel.

8. The blank in accordance with claim 1, wherein the blank is configured so the container is formed without using any adhesive for adhering one panel to another.

9. A polygonal container comprising: a bottom wall, the bottom wall having at least one side edge, and at least one end edge; two opposing side walls, each side wall emanating from a side edge of the bottom wall; two opposing end walls, each end wall comprising an end panel and a foldover panel, each end wall emanating from an end edge of the bottom wall, each foldover panel opposite the end edge and configured to lock the container in at least a partially formed position; and a first reinforcing panel assembly extending between a first end wall of the two end walls and a first side wall of the two side walls, the first reinforcing panel assembly including: an outer reinforcing corner panel emanating from a side edge of the first side wall; a first reinforcing end panel emanating from a side edge of the outer reinforcing corner panel;

a second reinforcing end panel emanating from a side edge of the first reinforcing end panel; and an inner reinforcing corner panel emanating from a side edge of the second reinforcing end panel, wherein the outer reinforcing corner panel and the inner reinforcing corner panel are disposed in juxtaposed face-to-face relation to one another to form a corner wall extending from an end edge of the first side wall to an end edge of the first end wall, wherein the inner reinforcing corner panel defines a terminal edge of the reinforcing panel assembly;

wherein the first reinforcing end panel comprises a first cutout defined along a top edge thereof; and the second reinforcing end panel comprises a second cutout defined along a top edge thereof; wherein the first cutout aligns with the second cutout to form a locking slot when the first reinforcing end panel is folded inwardly in a face-to-face relationship with the second reinforcing end panel.

10. A polygonal container in accordance with claim 9, wherein the reinforcing panel assembly is a first reinforcing panel assembly and further comprising: a second reinforcing panel assembly extending between the first end wall and a second side wall of the two side walls; a third reinforcing panel assembly extending between a second end wall of the two end walls and the second side wall; and a fourth reinforcing panel assembly extending between the second end wall and the first side wall, each of the first, second, third, and forth reinforcing panels assemblies forming a respective corner wall, with one of the corner walls at each end of each of the two opposing side walls, and wherein respective inward facing surfaces of each of the two opposing side walls extending between the respective corner walls face each other substantially free of any panels intervening between the inward facing surfaces.

11. The polygonal container in accordance with claim 10, wherein each of the two opposing end walls further comprises at least one hinge tab, each of the pair of locking slots receives one of the hinge tabs, the foldover panels folded inwardly to at least partially overlie at least one of the first and fourth reinforcing panel assemblies.

12. The polygonal container in accordance with claim 10, wherein the container is free of any adhesive adhering any one panel to any other panel.

13. The polygonal container in accordance with claim 10, wherein the bottom panel is rectangle-shaped.

* * * * *